United States Patent [19]

Lloyd

[11] Patent Number: 4,733,273

[45] Date of Patent: Mar. 22, 1988

[54] LIQUID DEVELOPING APPARATUS

[75] Inventor: William A. Lloyd, Los Altos, Calif.

[73] Assignee: Xerox Corporation, Stamford, Conn.

[21] Appl. No.: 880,772

[22] Filed: Jul. 1, 1986

[51] Int. Cl.[4] ..... G03G 15/10

[52] U.S. Cl. ..... 355/10; 118/660; 118/661; 354/318

[58] Field of Search ..... 355/3 R, 10; 354/317, 354/318; 118/651, 659, 660, 661

[56] References Cited

U.S. PATENT DOCUMENTS

| | | | |
|---|---|---|---|
| 3,203,395 | 8/1965 | Liller | 118/637 |
| 3,256,855 | 6/1966 | Oliphant | 118/637 |
| 3,367,791 | 2/1968 | Lein | 117/37 |
| 3,418,912 | 12/1968 | Land et al. | 354/318 |
| 3,560,204 | 2/1971 | Damm | 96/1 |
| 3,575,101 | 4/1971 | Smith et al. | 354/318 X |
| 3,940,782 | 2/1976 | Neeb et al. | 354/318 |
| 3,943,541 | 3/1976 | Hirafuji | 354/318 |
| 4,127,082 | 11/1978 | Kawabata | 118/652 |
| 4,141,317 | 2/1979 | Lakhani | 118/661 |
| 4,454,833 | 6/1984 | McChesney et al. | 118/652 |
| 4,686,936 | 8/1987 | Chow | 118/661 |

FOREIGN PATENT DOCUMENTS 1384268 2/1975 United Kingdom .

*Primary Examiner*—Fred L. Braun

*Attorney, Agent, or Firm*—W. Douglas Carothers, Jr.

[57] ABSTRACT

A liquid developing apparatus is provided for developing, with a liquid developer or toner, an electrographic latent image formed on an image bearing, charge retaining surface of a moving recording medium and thereafter wiping excess developer from the medium surface. The apparatus is designed to require only a single developer/wipe roll to perform the dual function of image development surface wiping. The single developer/wipe roll is supported for rotational movement in a direction opposite to the direction of movement of the recording medium and is in forward and leeward tangential engagement with a portion of the moving medium surface, respectively, to form a development apex and fluid seal between it and the recording medium surface and to wipe the recording medium surface to promote surface drying.

17 Claims, 4 Drawing Figures

LIQUID DEVELOPING APPARATUS

BACKGROUND OF THE INVENTION

This invention relates to apparatus for applying liquid developer to the surface of a recording medium moving in a path relative to the apparatus and more particularly to liquid developer apparatus employing a single developer roll for providing the dual functions of forming a development apex for developing a latent electrographic image on the surface of the recording medium and a wiping action to remove excess liquid developer from and dry the surface of the developed recording medium.

The art of liquid toning or development of a previously formed electrographic latent image formed on the image bearing surface of a recordingmedium with a liquid toner or developer is a well established art. Typical of the present state of the art are U.S. Pat. Nos. 4,127,082 and 4,454,833. In the first of these patents, the applicator roll for the developer is partly submerged in a liquid developer bath with the roll rotated at a sufficiently high velocity to raise the developer from the bath in the form of a thin film on the surface of the roll due to viscous friction for delivery to to a development gap formed between the applicator roll and the surface of the recording medium. In the second of these patents, the liquid developer is supplied to a region of the rotated applicator roll with flow controlling means positioned in spaced relation to the surface of the applicator to meter the amount of developer applied to and carried on the roll to a development gap formed between the applicator roll and the surface of the recording medium. In both of these types of developing apparatus, a printing gap is established between the surface of the roll and the recording medium surface for delivery of toning liquid and development of the recording medium is followed engagement by the recording medium with a second roll rotated in the opposite direction relative to the applicator roll for wiping excess liquid developer from the medium surface and drying the same. Two rolls may be employed to provide a single development gap or or a series of development gaps, such as disclosed in U.S. Pat. Nos. 3,203,395, 3,256,855 and 4,141,317. The applicator roll may be rotated in a direction opposite to the the direction of movement of the recording medium, such as disclose in U.S. Pat. No. 3,367,791 and UK Pat. No. 1,384,268 and may have a bias applied the development gap to accomplish the developing action, such as disclosed in UK Pat. No. 1,384,268 and U.S. Pat. No. 3,560,204.

The present method of liquid development of recording media, particularly in the electrographic printer/plotter art, is the use of a series combination of an applicator roll and dry or wipe roll as illustrated in the first mentioned patents above as well as in the Benson Electrographic Printer/plotter Model 9336, manufactured by Benson, P.O. Box 32059, 2600 Orchard Parkway, San Jose, CA 95152. Due to high speed movement of the recording medium to reduce printing time and the necessity to print multiple colors by successive passage of the same section of the recording medium over several different color developing apparatus, it is important to immediately wipe excess developer off of the medium surface and invoke medium surface drying to insure that its image bearing surface will not become smeared on the next pass of the medium for latent image writing and subsequent development as well as prevent electrographic head damage caused by electrode shorting due to a wet medium surface.

While these known liquid developing apparatus may have good application for applying liquid developer to the image bearing surface of the recording medium, it would be desirable to eliminate the need of using a second wiping and drying roll by combining the wipe/dry function and developing function into a single roll capability. This would have the advantage of reducing the cost of the apparatus by eliminating the need for the second roll and its drive means (motor and coupling arrangement). Also, the length of the machine bed could be reduced since there would not be two roll in series along the path of movement of the recording medium. However, the elimination of the second wiper/dry roll has been thought not possible since with the establishment of the development gap between the applicator roll and the medium surface, how is one to apply liquid developer into the region of the gap and concurrently wipe excess developer from the same medium surface to promote the drying of its surface?

Another problem is the elimination of background stains when the recording medium is momentarily stopped during application of liquid developer to the the image bearing surface. While the source of developer may be stopped when medium is stopped, the meniscus formed at the development gap will still remain for a short period of time and continue to tone the medium surface at the point of the remaining meniscus. What is needed is some means by which this meniscus is immediately broken and removed upon cessation of the liquid developer supply.

These problems are substantially eliminated by the liquid developing apparatus of this invention.

SUMMARY OF THE INVENTION

According to this invention, a liquid developing apparatus is provided for developing with a liquid developer and wiping an electrographic latent image formed on an image bearing, charge retaining surface of a moving recording medium comprising a single developer/wipe roll supported for rotational movement in tangential engagement with the surface of the recording medium forming a development apex between the surface of the roll and the recording medium. The circumference of the roll is sufficiently large to provide an extended tangential engaging surface with the recording medium surface. A baffle plate is supported in spaced relation to the roll and positioned upstream from the roll relative to the moving recording medium for receiving the liquid developer between it and the roll and directing the liquid developer into the development apex. The top of the baffle plate is spaced from the recording medium surface to form an outlet for liquid developer from the development apex over the top of the plate. The roll is rotated in a direction against the direction of movement of the recording medium to form a seal between the roll and the recording medium to prevent toner from passing between them. The extended tangential engaging surface comprises a first portion of forward tangential engagement with the surface of the recording medium to form a seal with the recording medium surface and to force expended liquid developer in the development apex toward the outlet and a second adjacent portion of leeward tangential engagement with the surface of the recording medium to wipe the recording medium surface.

Other objects and attainments together with a fuller understanding of the invention will become apparent and appreciated by referring to the following description and claims taken in conjunction with the accompanying drawings.

DETAILED DESCRIPTION OF THE PREFERRED EMBODIMENTS

Through out the description, the terms "toner", "developer", "liquid toner" and "liquid developer" are used interchangeably to indicate a developer having entrained toner particles (e.g. carbon) in a liquid carrier medium for developing a latent electrostatic image formed on the charge retaining surface of a recording medium. Also, the developing or toner unit is equally applicable to the toning of individual sheets of recording medium as well as a continuous web of recording medium.

Figure 1:
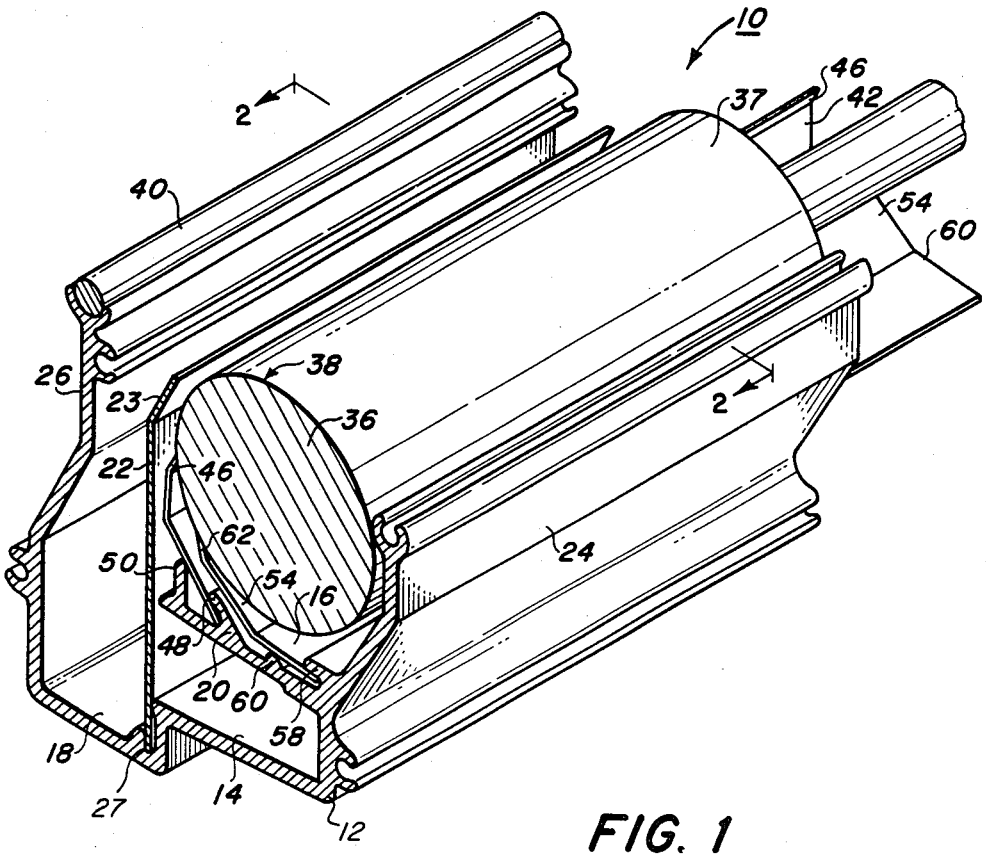
FIG. 1 is a partial perspective view of the liquid developing apparatus of this invention.
Figure 2:
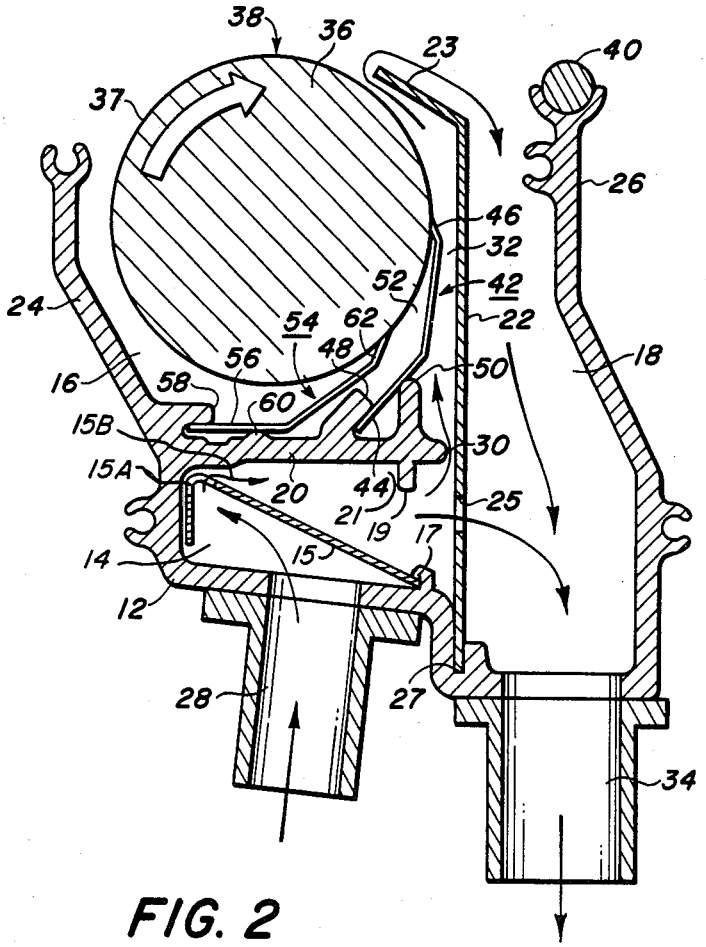
FIG. 2 is a cross sectional view taken along the line 2—2 of FIG. 1.

Reference is now made to FIGS. 1 and 2 wherein there is shown the liquid developer apparatus 10 comprising this invention. Apparatus 10 comprises a frame 12, e.g. mode of aluminum or plastic, an inlet chamber 14, a development chamber 16 and an outlet chamber 18. Inlet chamber 14 and development chamber 16 defined by frame extension 20, baffle plate 20 and rear frame wall 24. Outlet chamber is defined by baffle plate 22 and front frame wall 26. Chamber 14 has a toner inlet 28 through which liquid toner is supplied from a pumped toner source (not shown) to chamber 14, thence through restriction 30 into passageway 32 adjacent to baffle plate 22. The bottom of outlet chamber 18 is provided with a toner outlet 34 for return to of expended developer or toner liquid to a toner reservoir (not shown). The arrows shown in FIG. 2 indicate the flow path of toner or developer through chambers 14, 16, 18 including some flow through apertures 25.

As an additional feature, apparatus 10 may include a means to trap air bubbles present in the liquid toner or developer that will effect the uniformity of development if they are present at apex 70. As shown only in FIGS. 2 and 3, there is disposed an angled restriction plate 15 with a series of apertures 15A along its angled edge positioned in chamber 14. Plate 15 is positioned in chamber 14 by forcing the end of the plate over ridge 17 on the bottom of chamber 14. Toner entering chamber 14 via inlet 28 will be forced to flow through apertures 15A at the back end of chamber 14 before actually proceeding further through the chamber, as indicated by arrow 15B. As a result, any air bubbles entrained in the liquid toner are trapped at 21 by protrusion fence 19 depending downwardly from extension 20, preventing these air bubbles from proceeding through restriction 30 to apex 70 and interfering with the development process.

Baffle plate 22 has a bent portion 23 at its upper end. The lower end of plate 22 is force fit into elongated groove 27 in the bottom of frame 12.

Baffle plate 22 also includes in the lower portion thereof a series of small apertures for fluid communication between inlet chamber 14 and outlet chamber 18, the purposes of which will be explained later.

Roll 36 is rotatably mounted in developer chamber 16 positioned as shown in FIGS. 1 and 2 so that the top point 38 of roll 36 is just about horizontal with the top of guide bar 40 mounted on the top of front frame wall 26. Horizontal alignment is not critical, as the purpose of bar 40 is to guide the recording medium to the surface engagement of roll 36 forming a developing apex with the roll and a passage inlet above the bent portion 23 of baffle plate 22.

Roll 36 has a highly smooth and polished surface and may be made of any hard substance to provide such a surface. In the embodiment shown, roll 36 is made from stainless steel with a mirror polished surface. Surface 37 could also be a chromium mirror finish.

Developer chamber 16 also includes doctor blade 42 mounted with its blade end in engagement with surface 37 of roll 36. The lower portion 44 of doctor blade 42 is positioned between elongated protrusions 46 and 48 so that lower portion 44 of doctor blade 42 is positioned between elongated protrusions 48 and 50 so that doctor blade is held in position by the engagement of roll 36 against blade portion 46, slightly forcing blade 42 into a biased, cantilevered position between protrusions 48 and 50. The purpose of doctor blade 42 is to provide a seal between roll surface 37 and blade portion 46 to prevent liquid toner from entering region 52 as well as wiping roll 36 of toner. Also, due to the presence of the back surface of doctor blade 42 in toner passageway 32, the force of liquid toner through this passageway will also act to push blade 42 against surface 37 of roll 36 to promote the forming of this seal.

Below doctor blade 42 is mounted scraper blade 54 with lower portion 56 mounted between protrusions 58 and 60 of frame extension 20 and with its upper portion 62 in engagement with the surface of roll 36. Scraper blade 54 is held in position by engagement of roll 36 against blade portion 62, slightly forcing blade 54 into a biased, cantilevered position between protrusions 56 and 58. The purpose of scraper blade 54 is to dislodge any particles of toner that have solidified on the surface of roll 36. When the operation of developing apparatus 10 is terminated for any sufficient period of time, such as over a period of a day or so, over night or over weekends, toner film still present on the surface of roll 36 will dry and harden. The surface of roll 36 must be maintained smooth and free of irregularities for proper operation. Upon subsequent operation of apparatus 10, scraper blade 54 will remove such particles or irregularities from its surface. Blades 42 and 54 may be made of any suitable spring-like, hard but resilient material. In the embodiment shown in FIGS. 1 and 2, these blades are comprised of a half hard beryllium copper alloy.

While the arrangement of both a doctor blade 42 and scraper blade 54 are shown in the embodiments of FIGS. 1 and 2 of this invention, it should be noted that a single blade may be used in the place of both of these blades to perform both the functions of a seal and scrapper. Such an arrangement in the same type of developing apparatus is shown in U.S. patent application Ser. No. 880,756, filed July 1, 1986, which is incorporated herein by reference thereto. However, the use of two blades provides additional insurance of proper maintenance of the surface of roll 36 as well as permit the addition of toner flow pressure as an aid in seal maintenance, the latter of which will be explained in more detail later. However, as to maintenance insurance, the maintenance of a clean roll surface free of any toner contaminants as the roll rotates into engagement with the recording medium is important when an electric field is applied to the recording medium to enhance the development process and attraction of developer particles as is known in the art. Such fields cannot be uniformly applied if any toner contaminants are left on its surface, as they will undesirably attract the applied medium field bring about additional development on the medium surface. The undesired effect will be a darker toned background. The use of two wiper blades insures that the roll surface is free from such contaminants.

Figure 3:
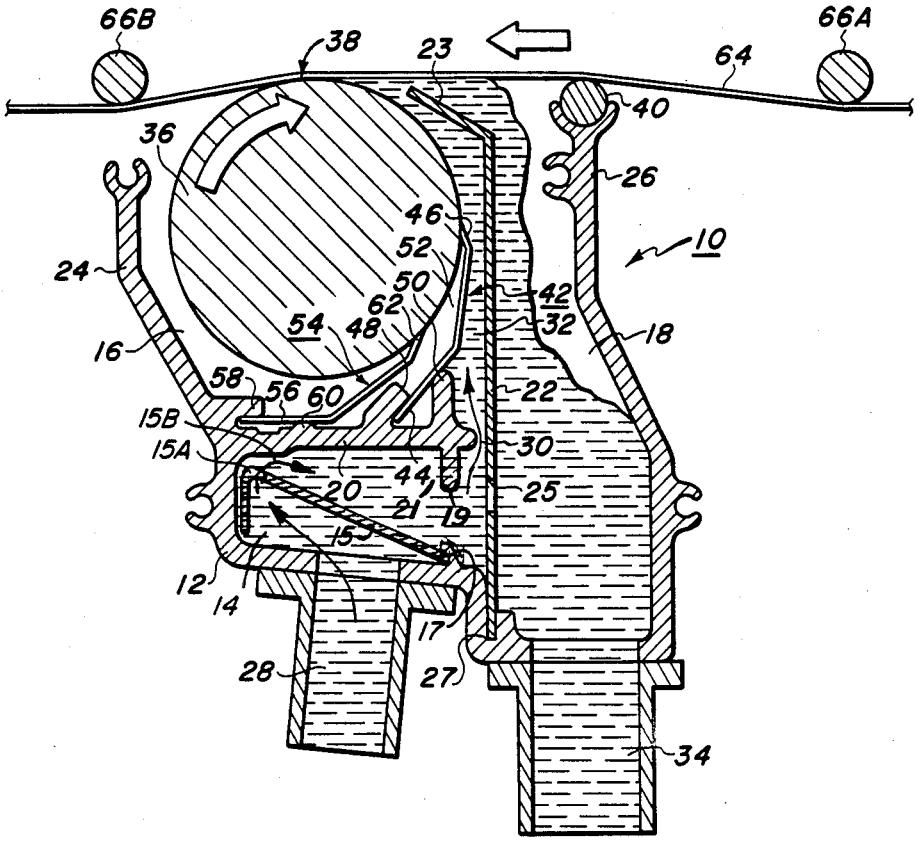
FIG. 3 is a cross sectional view like FIG. 2 with the presence of the recording medium in engagement with the fountain and the liquid developer being supplied to the apparatus.
Figure 4:
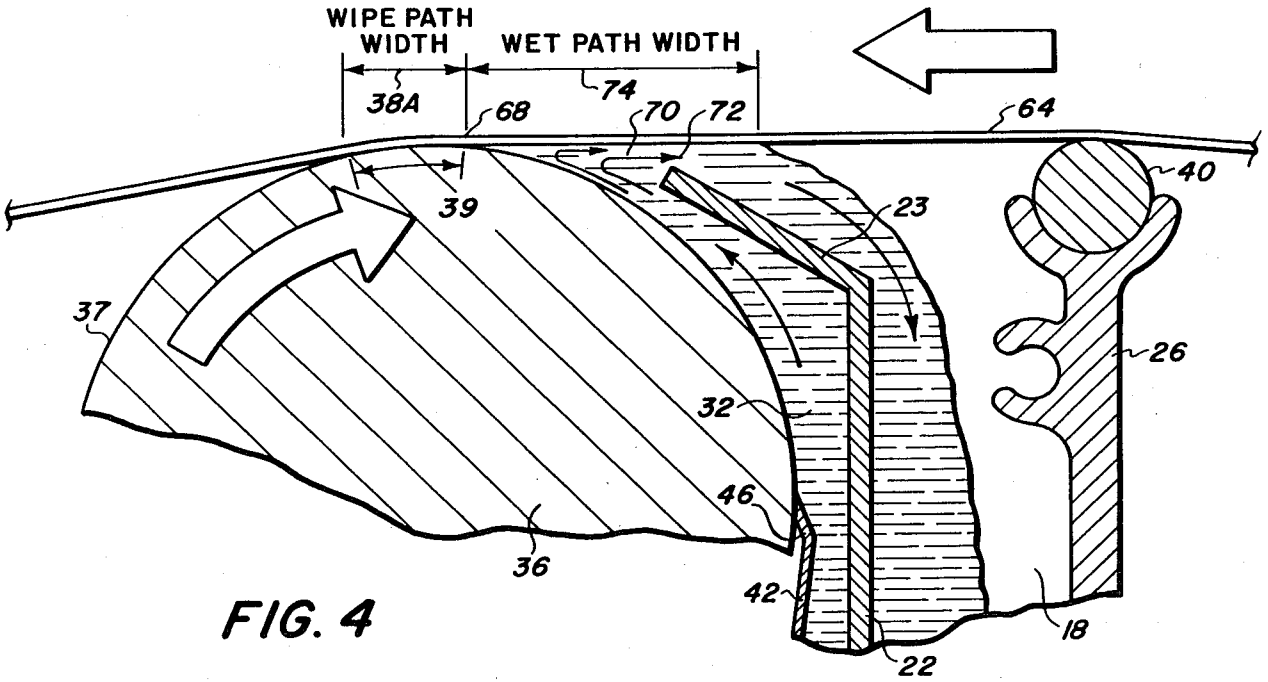
FIG. 4 is a very enlarged view of a portion of FIG. 3 showing details of engagement of the recording medium with the apparatus roll and the formation of the development apex therebetween.

Reference is now made to FIGS. 3 and 4 to explain further details with regard to apparatus 10 during its operation. As shown in FIG. 3, record medium 64 is brought into engagement into roll 36 at point 38 by means of backrests 66A and 66B which are generally parts supported in the lid of the machine in which apparatus 10 is mounted. Medium 64 may be comprised of transparent acetate based medium with an inner conductive layer and top dielectric layer or a paper base medium with a top dielectric layer. The direction of movement of roll 36 is opposite to the direction of medium 64. The rotation of roll 36 against medium 64 at point 38 establishes a seal at 68 (FIG. 4) over a wipe path width indicated at 38A as well as forms a development apex 70 between moving medium 64 and the surface 37 of roll 36.

The length of wipe path width 38A is referred to as an extended tangential engagement surface relative to passing medium and forms two portions to perform two functions. The first portion is at 68 where a seal is formed with the surface of recording medium 64 and to force expended liquid toner or developer from between roll 36 and medium 64 back into apex 70 toward apex outlet 72 thereby allowing fresh liquid toner to enter the region of apex 70. The second portion is the leeward tangential engagement of medium 64 over a length of roll surface 37 indicated by arrow 39 to wipe the surface of recording medium 64 to promote its drying.

An important aspect of this invention is the fact that there is no development gap established between roll 36 and medium 64 as found in cases of the prior art but rather a seal 68 is formed at this point to form a development apex 70 forward of the seal.

The rotational velocity of roll 36 is not critical but must be rotated at a velocity sufficient to form seal 68. An example of rotational velocity for roll 36 may be about 100 rpm with a medium velocity of about 1 inch per second. The rotation velocity of roll 36 is not critical to the operation of apparatus 10, i.e. it may be varied through a range depending upon medium velocity and roll diameter. However, if roll 36 is rotated too fast, it will begin to pick up and carry air bubbles along its surface, which is undesirable because it does not permit uniform development with the established meniscus at apex 70. If roll 36 is rotated too slow, the surface of medium 64 will not be sufficiently dry, i.e. too wet, when it leaves apparatus 10 taking into account the diameter of roll 36. Thus, the velocity of roll 36 in conjunction with medium velocity and roll diameter should be selected to accomplish a good drying draw of the medium surface.

As seen in FIG. 3, toner enters chamber 14 via inlet 28 and passes through restriction 30 into passage 32 along the elongated length of apparatus 10. Restriction 30 under the pressure of the flow spreads the toner flow laterally and evenly along the length of the restriction so that liquid developer is presented along the full length of passage 32 for uniform flow into the development apex 70. In this regard, baffle bent portion 23 helps to guide the fluid flow into apex 80 and maintain a continuous supply to toner to apex 70.

As indicated by the arrows in FIG. 4 in apex 70, liquid toner is presented to the undersurface of medium 64. Due to the seal 68 and the opposite direction movement of roll 36 relative to medium 64 as well as the routine pumped flow of liquid toner, the toner presented to apex 70 is forced to flow over the top of baffle bent portion 23 at apex outlet 72, thence over the outside surface of baffle 22 and into toner outlet chamber 18. Thus, during operation of apparatus 10, that is the rotation of roll 36 and the presentation of liquid toner to apex 70, there is a widthwise portion of medium 64 continually in contact with fluid toner forming a toner meniscus, which is shown as the wet path width 74.

Seal 68, besides performing a sealing barrier between moving medium 64 and roll surface 37, also provides a drying function by wiping the medium surface over the wipe path width 38A indicated in FIG. 4 to remove excess toner from the medium surface and promote surface drying of the medium surface in preparation for the next pass of the same medium section over another developer apparatus. The width 38A should be sufficiently large to provide this wiping function and it has been found that a wipe path width measure by an arc of about 10° to 15° relative to the radius of roll 36 is sufficient. This width can be increased or decreased, as desired, by increasing either the diameter of roll 36 or increasing or decreasing the wrap of medium 64 on roll 36 by lowering or raising, respectively, the elevation backrest 66B relative to the position of roll 36 or performing both adjustments together. In this connection, it should be noted that the diameter of roll 36 has been made sufficiently large to obtain a wipe path width 38A of about 10° to 15° of surface 37 without any significant medium wrap being imposed by backrest 66B. The circumference of roll 36 should be relatively large to form a large tangential arc relative to medium 64. This establishes a longer apex point 70A providing closer electric development fields established over a longer path distance at this point.

The advantages of single roll 36 over the prior art, besides the elimination of one of two rolls, is the dual function of development and wipe/dry by means of rotation of roll 36 in a reverse direction to the direction medium movement in conjunction with positive pumped toner into the formed development apex 70 forming a meniscus with medium 64 along the wet path width 74. Apex 70 is sufficiently small to establish a meniscus quickly. When pumping of liquid toner to apparatus 10 is terminated, the toner remaining in chamber 14 and passageway 32 drops immediately due to drainback apertures wherein the toner in these regions quickly falls by gravity through apertures 25 into outlet chamber 18 and outlet 34. The established meniscus at path width 74 is quickly broken up due to the sweeping-out action of roll 36 rotated into the moving medium. As a result, no toner or developer signature or stain is formed on medium 64 at this point, as there has not been a sufficient period of time to establish such a signature.

It should be understood that the force and volume of the pumped toner is sufficient to overcome the additional flow through drain back apertures 25 to provide adequate flow to apex 70 and form a proper meniscus with medium 64. However, termination of toner flow into apparatus 10 permits apertures 25 to become an immediate fluid exit for toner present in chamber 14 and passageway of apparatus 10 to move quickly and directly to outlet 34.

As an example of an exemplary embodiment the width of development apex 70 from the top of baffle bent portion 23 to the surface of medium 64 may be in the range of 0.05 to 0.150 of an inch. The distance between the inside surface at the top of baffle portion 23 and the surface of roll 70 adjacent thereto may be in the range of 0.04 to 0.10 of an inch. However, it has been determined that these ranges are not critical, as changes can be made to these limits in relation to each other and still provide a functional development unit. Important aspects to consider are that if the width of development apex 70 from the top of baffle bent portion 23 to the surface of medium 64 is too large, the meniscus with the medium surface above apex 70 will never be established. If this width is too narrow, the established meniscus will be difficult to break up upon toner pump termination, raising the possibility of staining the medium surface with excess toner.

Pumping of liquid toner is always terminated prior to termination, of rotation of roll 36 to insure immediate meniscus breakup at path width 74.

While the invention has been described in conjunction with a few specific embodiments, it is evident to those skilled in the art that many alternatives, modifications and variations will be apparent in light of the foregoing description. Accordingly, the invention is intended to embrace all such alternatives, modifications and variations as fall within the spirit and scope of the appended claims.

What is claimed is:

1. A liquid development apparatus for developing with a liquid developer and wiping excess developer from an electrographic latent image formed on an image bearing, charge retaining surface of a moving recording medium comprising:

a roll supported for rotational movement in tangential engagement with the surface of said recording medium forming a development apex between the surface of said roll and said recording medium, the circumference of said roll sufficiently large to provide a tangential engaging surface with said recording medium surface, a baffle plate supported in spaced relation to said roll and positioned upstream from said roll relative to said moving recording medium for receiving a flow of said liquid developer between it and said roll and directing said liquid developer into said development apex to form a meniscus with the surface of said recording medium, the top of said baffle plate spaced from said recording medium surface to form an outlet for liquid developer from said development apex over the top of said plate, said roll rotated in a direction against the direction of movement of said recording medium to form a fluid seal between the surface of said roll and said medium to prevent liquid developer from passing therebetween, said tangential engaging surface against said medium movement comprising a first portion of forward tangential engagement with the surface of said recording medium to form said fluid seal with said recording medium surface and to force expended liquid developer in said development apex toward said outlet and a second adjacent portion of leeward tangential engagement with the surface of said recording medium to wipe said recording medium surface.

2. The liquid development apparatus of claim 1 wherein a doctor blade is supported against the surface of said roll on the forward surface thereof toward the advancing recording medium.

3. The liquid development apparatus of claim 2 wherein said doctor blade is mounted in a developer passage in a manner that its outer surface is engaged by the flow of liquid developer to force said doctor blade against the surface of said roll.

4. The liquid development apparatus of claim 2 wherein there is a scraper blade positioned behind said doctor blade relative to the direction of movement of said roll.

5. The liquid development apparatus of claim 1 wherein an upper portion of said baffle plate is bent toward said development apex to form a developer passage at said outlet over which said expended liquid developer flows.

6. The liquid development apparatus of claim 1 wherein at least one aperture is provided between a liquid developer passage and said liquid developer outlet to permit the immediate back drain of said liquid developer upon cessation of liquid developer supply to said apparatus, the size of said aperture being sufficiently small so as not interfere with the supply of said liquid developer to said development apex upon pumping of said liquid developer to said apparatus.

7. The liquid development apparatus of claim 1 wherein there is provided means to trap air bubbles entrained in said liquid developer prior to its delivery to said apex.

8. In a developing apparatus for developing electrographic images formed on a surface of a recording medium as the recording medium is moved relative to engagement with said apparatus and comprising:

a rotatably supported developer roll rotated in a direction opposed to the direction of movement of said recording medium and positioned in tangential engagement with said recording medium surface to form a development apex between the circumferential surface of said roll and said recording medium surface, means to pump developer directly from an inlet passage into and along the full length of said formed development apex and form a meniscus with said recording medium surface during the active pumping of said developer, means to guide excess or expended developer away from said development apex in an opposite direction to medium movement to an outlet passage, means to form a wrap angle of said medium surface in tangential engagement with said roll of sufficient wrap length, and in conjunction with said opposed movement, to form at its forward extent a fluid seal at the rearward tip of said development apex and to form at its leeward extent a wiping action on said recording medium surface, said opposed rotational movement of said developer roll functioning to breakup and sweep away said meniscus upon cessation of pumping of said developer.

9. In the developing apparatus of claim 8 including means in said apparatus to permit immediate withdrawal of pumped developer present in said inlet passage and leading into said development apex upon cessation of pumping of said developer.

10. In the developing apparatus of claim 9 wherein said withdrawal means comprises means to short circuit the flow of fluid developer from said inlet passage to said outlet passage.

11. In the developing apparatus of claim 8 wherein said wrap angle is in the range of about 10° to 15°.

12. The developing apparatus of claim 8 wherein a doctor blade is supported against the circumferential surface of said developer roll at a point along the surface thereof that is in advance of said development apex.

13. The developing apparatus of claim 12 wherein said doctor blade is mounted in said inlet passage in a manner that its outer surface is engaged by the flow of developer in said inlet passage to enforce said doctor blade against the surface of said roll during the active pumping of said developer.

14. The developing apparatus of claim 12 wherein a scraper blade is supported against the circumferential surface of said developer roll at a point along the surface thereof in advance of said doctor blade.

15. The developing apparatus of claim 8 wherein a baffle plate is supported in spaced relation to said roll and positioned upstream from said roll relative to said moving recording medium forming a portion of said inlet passage to receive said developer between it and said roll and directing said developer into said development apex, the top of said baffle plate spaced from said recording medium surface to form a developer exit to said outlet passage for receiving excess and expended developer from said development apex over the top of said baffle plate and for directing the same into said outlet passage.

16. The developing apparatus of claim 15 wherein the upper portion of said baffle plate is bent toward said development apex to direct said developer from said inlet passage into said development apex and to form a portion of said developer exit.

17. The developing apparatus of claim 8 wherein there is provided means to trap air bubbles entrained in said developer in said inlet passage prior to the delivery thereof to said development apex.

* * * * *